United States Patent [19]

O'Neill

[11] 4,114,527

[45] Sep. 19, 1978

[54] BALE TYING DEVICE AND KNOT PRODUCED THEREBY

[76] Inventor: Robert S. O'Neill, 7423 Sea View Pl., El Cerrito, Calif. 94530

[21] Appl. No.: 831,788

[22] Filed: Sep. 9, 1977

[51] Int. Cl.[2] ..... B65B 13/38

[52] U.S. Cl. ..... 100/2; 100/10; 100/31; 140/115; 289/1.5

[58] Field of Search ..... 100/2, 10, 11, 29, 31; 289/1.2, 1.5; 140/101, 104, 115; 53/135

[56] References Cited

U.S. PATENT DOCUMENTS

| | | | |
|---|---|---|---|
| 893,216 | 7/1908 | Wood | 100/11 |
| 1,744,113 | 1/1930 | Galvan | 100/10 |
| 1,889,372 | 11/1932 | Nolan | 100/31 |
| 2,150,755 | 3/1939 | Zimmerman | 140/101 |
| 2,937,484 | 5/1960 | Wiman | 53/135 |
| 3,338,273 | 8/1967 | Kalning | 140/101 |

*Primary Examiner*—Billy J. Wilhite

*Attorney, Agent, or Firm*—Newton, Hopkins & Ormsby

[57] ABSTRACT

A bale tying device whereby a wire is secured by knots around a bale of material, the device comprising means for receiving the distal portions of the wire in spaced, parallel relationship with the wire ends extending past each other in the opposite directions, means for bending each other in the opposite directions, means for bending each wire distal portion in the direction of the other distal portion at an angle so that each distal end passes through the vertical plane of those portions of the wire which are not bent and means for folding the distal ends about each unbent portion of the wire to form an open rectangular link or knot in which portion of each wire is looped around the other wire and then angles downwardly and in engagement with the bale.

13 Claims, 8 Drawing Figures

BALE TYING DEVICE AND KNOT PRODUCED THEREBY

BACKGROUND OF THE INVENTION

1. Field of the Invention

This invention relates to automatic bundling devices and, more particularly, to a device for tying bales of material by wire knots and the knot so formed.

2. Description of the Prior Art

Many machines and processes have been developed in the past for tying the straps around bales formed in cotton presses, hay presses and the like. Such mechanisms are shown in U.S. Pat. Nos. 893,216, issued to Wood on July 14, 1908; 1,889,372, issued to Nolan on Nov. 29, 1932; and 2,937,484, issued to Wiman on May 24, 1960.

Other devices have been developed for tying knots in wire and include those disclosed in U.S. Pat. Nos. 2,150,755, issued to Zimmerman on Mar. 14, 1939; and 3,338,273, issued to Kalning on Aug. 29, 1967.

Those devices incorporated complex mechanisms that were constantly subject to breakdown. Some of the prior devices included apparatus for severing the knot formed by the machine from the supply of wire. Additionally, the prior art mechanisms required the wire to be manipulated through many bending and shaping steps which maximized the stress on the wire. Such stress then caused the knots so formed by those machines to be readily subject to failure.

SUMMARY OF THE INVENTION

The present invention is designed to operate in conjunction with a compression mechanism for materials, such as cotton, so as to bind the compressed bales with wire knots. The device is positioned at a convenient location adjacent the compressed bale. A predetermined length of wire or a continuous length, ie, from a coil, is advanced along the sides of the bale in the same vertical plane so that the distal portions of the wire are received in opposite sides of the device. The wire portions advance through the device in spaced, parallel relationship with the distal portions extending past each other in opposite directions. Means are provided adjacent each distal portion to bend that portion inwardly such that it forms slightly more or less than a 90° angle with its unbent portion and extends through the vertical plane of the other unbent portion of the wire.

Means are also provided for folding about each unbent wire portion more than about 180° or less than about 360° each section of the bent distal portion which extends through the vertical plane of the unbent wire portion so that the distal ends of each distal portion are angled downwardly. The wire knot thus created is quite strong in that the loop portion of the knots or alternatively, the distal ends thereof may project into the fibers of the bale and a portion of the bale may protrude up through the substantially rectangular loop formed by the joined ends.

More specifically, as the ends of the wire pass through the device of the present invention, they each strike limit switches which actuate hydraulically operated arms positioned outwardly of each distal portion, each arm contacting the distal portion and moving that portion in a horizontal plane. As the distal portion is being bent, it passes over or underneath the other unbent wire portion. When the distal portions of the wire have been bent so, each section of the bent distal portion adjacent its distal end is received on a projection that extends from a rotatable element which has a downwardly opening, radially extending wire receiving slot throughout the length through which the wire is passed in its entry into the device. Each rotatable element is operable to rotate about a horizontal axis, that axis being coincident with the axis of the wire passing therethrough; each rotatable element is rotated upwardly so that the distal section of the wire which passed through the vertical plane of the unbent portion of the wire is folded approximately 275° about the unbent wire portion. Channels are formed in the underside of the device to allow the knot thus formed to be released from the device as the bale is lowered.

An object of the present invention is to provide an improved cabling wire knot and a device for forming the same.

Another object of the present invention is to provide a bale tying device wherein the wire is subjected to a minimum of stress and strain in forming the knot.

BRIEF DESCRIPTION OF THE FIGURES OF DRAWINGS

DESCRIPTION OF THE PREFERRED EMBODIMENT

Figure 1:
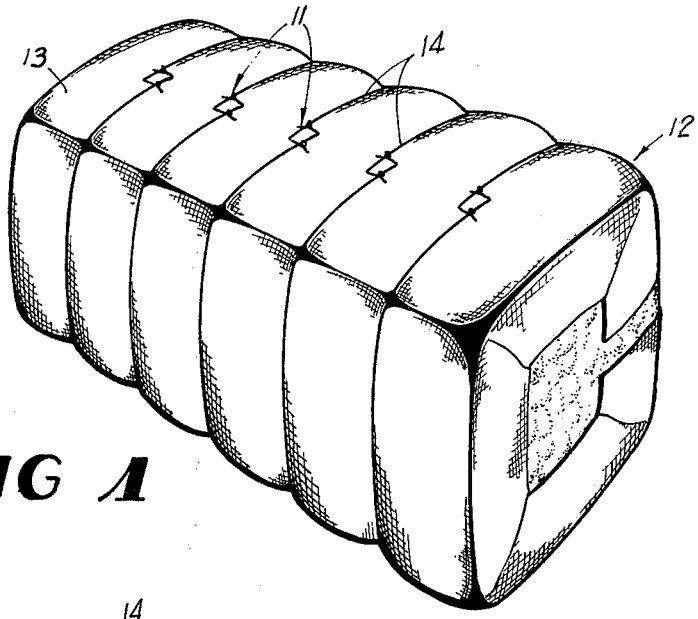
FIG. 1 is a perspective view of a bale of cotton baled utilizing wire tied by a knot produced according to the present invention.
Figure 2:
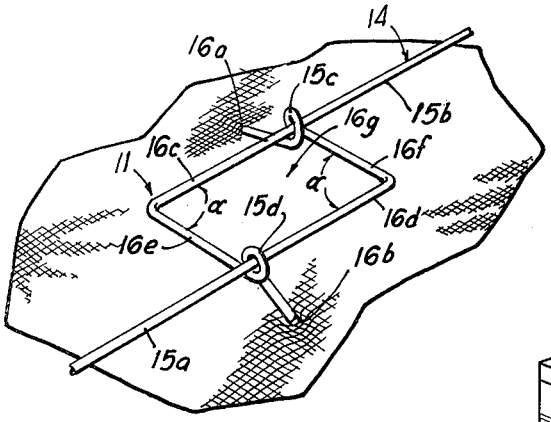
FIG. 2 is a detailed perspective view of the knot shown in FIG. 1.
Figure 3:
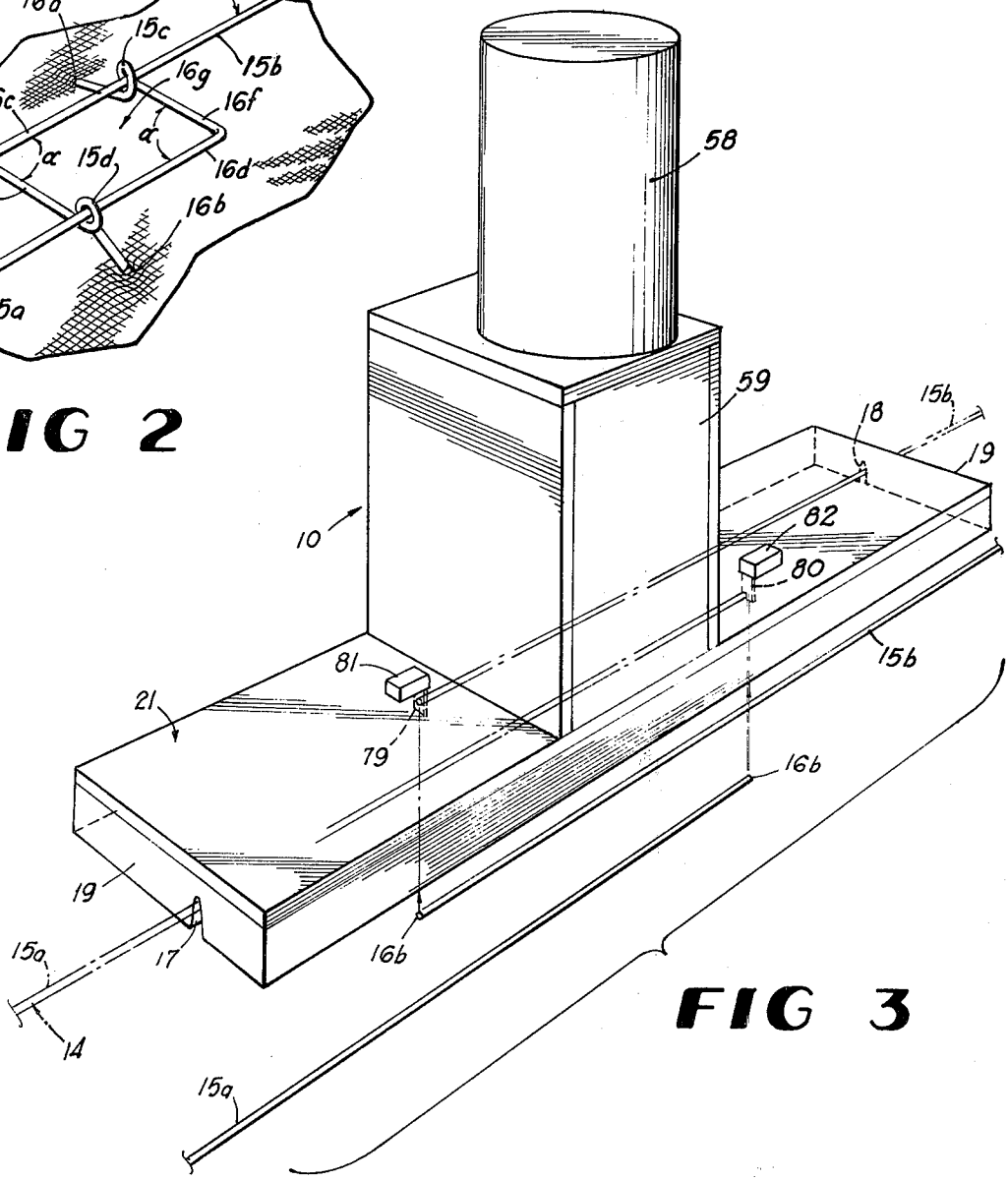
FIG. 3 is a perspective view of a baling device constructed in accordance with the present invention with the ends of the wire which it ties exploded for clarity.

The tying machine or device of the present invention is denoted generally by the numeral 10 as shown in FIG. 3. The knot formed by device 10 is denoted by numeral 11 in FIG. 2 and a bale which is secured by a plurality of wires 14 having knots 11 are shown in FIG. 1 and denoted by the numeral 12. The bale 12, which is of any compressible material such as cotton, rags, or hay, or other fibers is otherwise of conventional structure and is covered by a burlap sheet 13.

The bale 12 for illustration purposes, is shown to have five of the knots 11 formed in spaced, parallel fashion along its top. Each of these knots 11 are formed by a separate device 10 which is positioned at convenient locations adjacent to the compressed bale 12 in a conventional baling machine (not shown).

The length of wire 14 is, of course, greater than the outer perimeter of the compressed bale 12 around which it passes. The distal portions **15*a* and 15*b* of wire 14 have distal ends 16*a*, 16*b*, respectively. The wire employed by forming knot 11 is sufficiently rigid that once the loops 15*c*, 15*d* are formed, they remain in their bent condition. These loops 15*c*, 15*d* are sufficiently tight that they are self-locking in that they bind upon the intermediate increments 16*c*, 16*d* around which the loops 15***c*, 15*d* extend, particularly when lateral ie., longitudinal or axial, pull is exerted on the increment 16*c*, 16*d*, outwardly of knot 11. Pull exerted radially outwardly on increments 16*e*, 16*f* will enable the knot 11 to slide along increments 16*c*, 16*d* to take up slack ie., shorten the effective length of wire 14.

Figure 7:
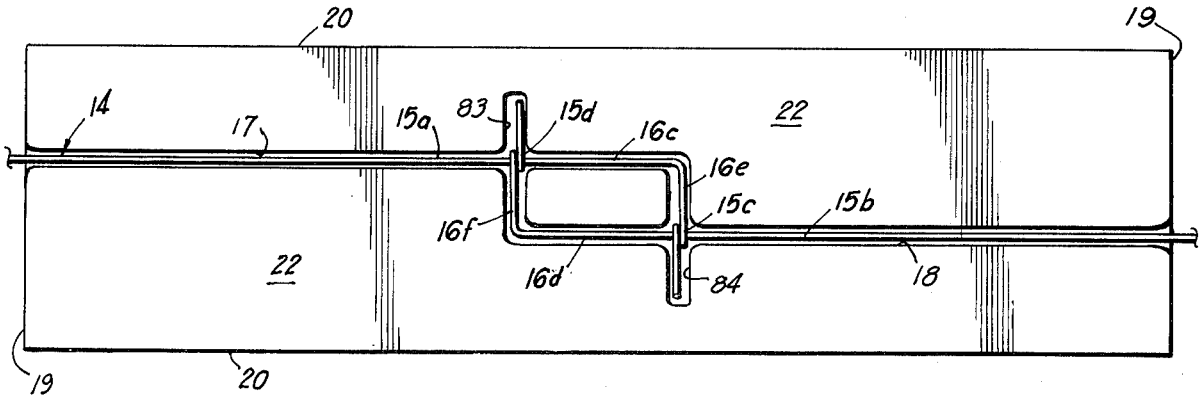
FIG. 7 is a bottom plan view of the device shown in FIG. 3.

The device 10 includes a lower box-like casing 9 having a rectangular frame formed of spaced, opposed, parallel, rectangular, transversely extending, vertically disposed end walls 19, the ends of which are joined by spaced, opposed, rectangular, parallel, longitudinally extending, vertically disposed side walls 20. A cover 21 is disposed over end walls 19 and side walls 20. The distal wire portions 15*a*, 15*b* are manually fed through downwardly opening guide channels 17, 18 end walls 19 of casing 9 of device 10. As seen in FIG. 7, the channels 17, 18 extend through bottom 22 of the casing 9 in opposed, offset parallel relationship until they both pass the midportion of bottom 22 when the channels 17, 18 turn toward each other, as described hereinbelow.

Figure 4:
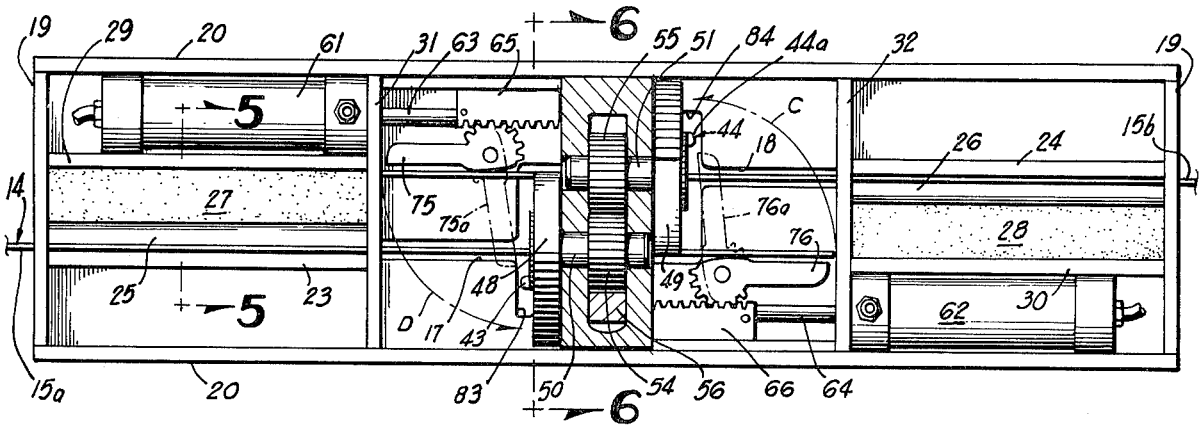
FIG. 4 is a horizontal sectional view of the device shown in FIG. 3.
Figure 5:
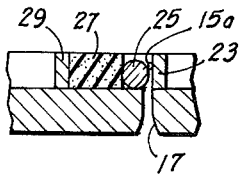
FIG. 5 is a cross-sectional view taken substantially along line 5—5 in FIG. 4.

With reference to FIGS. 4 and 5, it can be seen that above or inwardly of the channels 17 and 18 are the elongated cylindrical floating rollers 25 and 26 which are disposed respectively adjacent to longitudinally extending vertical fixed wall members 23 and 24 carried by side walls 20 and ribs 31, as shown in FIG. 4. The peripheries of rollers 25 and 26 are yieldably urged into engagement with the surfaces of wall members 23 and 24 by rectangular-shaped, longitudinally extending, resilient, elastomeric elements 27 and 28 which abut the sides of fixed longitudinally extending walls 29 and 30 which are parallel to and spaced from wall members 23 and 24.

As illustrated in FIG. 5, there is a sufficient opening between periphery of roller 25 and wall element 23 above the abutting increments of these respective elements, to receive and retain or support the horizontally inserted end portion 15*a* in their installed positions. The rollers 26 and its wall element 24 receive the end portion 15*b* in like fashion. The resilient, i.e. rubber, elements 27 and 28 are, however, sufficiently yieldable that when the wire 15 is pulled vertically downwardly, the end portions 15*a*, 15*b* will be stripped out of their positions between rollers 25, 26 and walls 23, 24.

Figure 8:
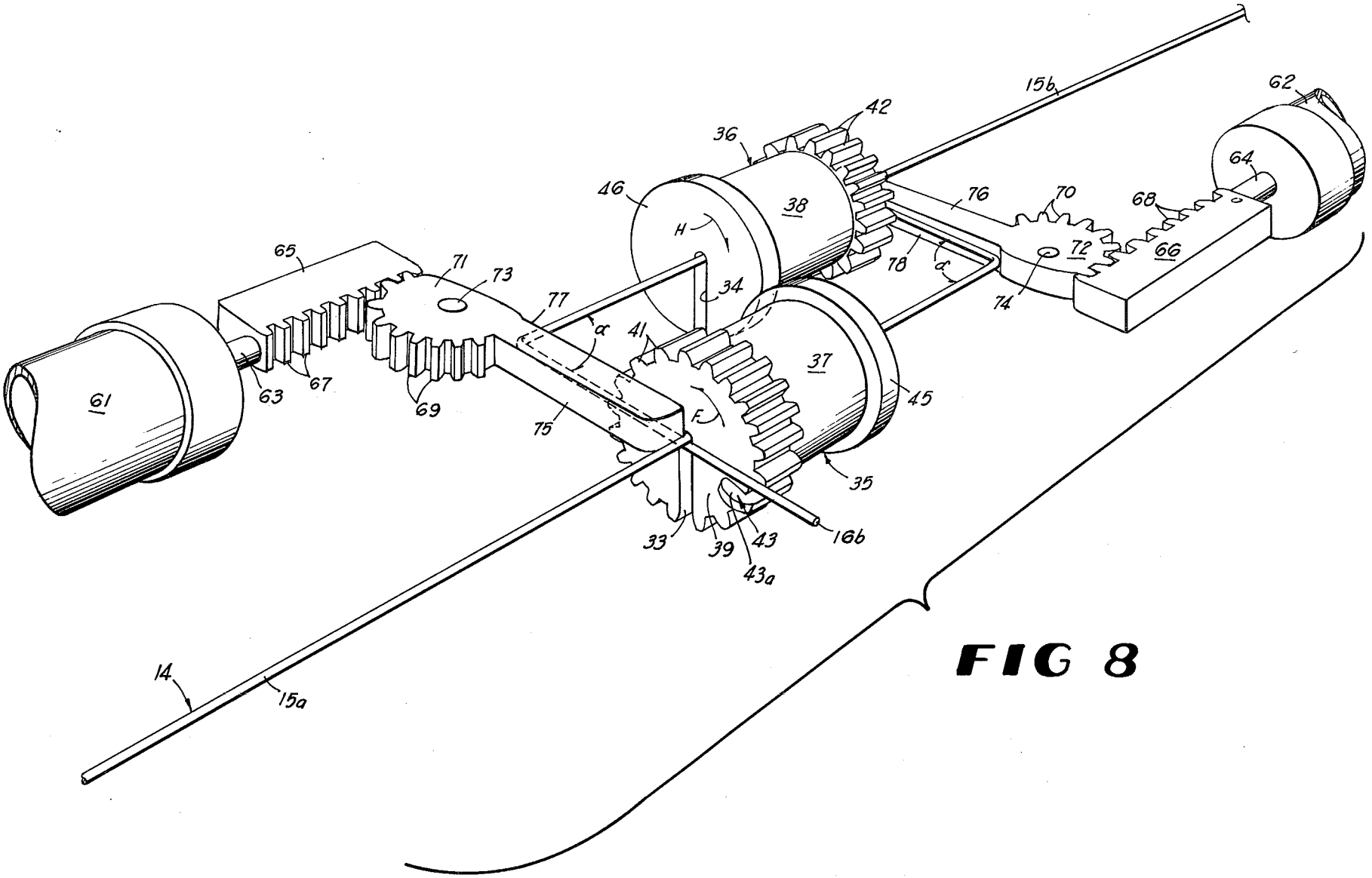
FIG. 8 is a perspective view of some of the elements of the device of FIG. 3 in one cycle of operation.

Normally, the outer periphery of rollers 25, 26 are in abutting engagement with their respective wall members 23, 24. The rollers 25, 26 and the wall members 23, 24 form a means for aligning the distal wire portions 15*a*, 15*b* within the device 10. When the end portions 15*a*, 15*b* are received by the rollers 25, 26 and elements 27 28 they rest axially along the entire periphery of the rollers 25, 26 in the generally v-shaped grooves formed by the rollers 25, 26 and elements 23, 24 as the end portions 15*a*, 15*b* are moved inwardly beyond rollers 25, 26 their ends pass through openings in transverse wall elements 31, 32 which are parallel to end walls 19 and are received through downwardly openings, radially extending, slots 33, 34 which are longitudinally formed through folding means comprised of rotatable elements 35, 36. As seen in FIG. 8, the rotatable elements 35, 36 have central cylindrical portions 37, 38 with cog wheels or gears 39, 40 being secured to their forward walls. The gears 39, 40 have continuous teeth 41, 42 formed along their outer periphery. The forward vertical faces of cog wheels 39, 40 are planar. Projections 43 and 44 extend beyond the forward, vertical faces of gears 39, 40, respectively adjacent the periphery of the gears 39, 40 to provide flat wire receiving surfaces 43*a*, 44*a*, respectively. Round plates 45, 46 are secured to the end walls of cylindrical portions 37, 38.

Figure 6:
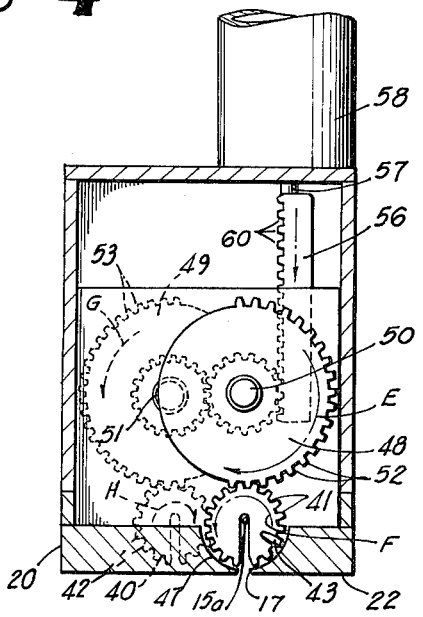
FIG. 6 is a cross-sectional view taken substantially along line 6—6 in FIG. 4.

It can be seen in FIG. 6 that rotatable element 35 is positioned within a trough 47 formed through the top surface of bottom 22. Rotatable element 36 is similarly provided with such a trough (not shown). Each of the channels 17, 18 extends through the bottom of the respective troughs so that when the rotatable elements 35, 36 are at rest, the slots 33, 34 are in registry with channels 17, 18, respectively.

Referring to FIGS. 6 and 4, rotational movement to rotatable elements 35, 36 is provided through large gears 48, 49 mounted on horizontally disposed shafts 50, 51 which are journaled within the device 10. The teeth 52, 53 dispose halfway about the periphery of the gears 48, 49 are in engagement with teeth 41, 42, respectively, of gears 39, 40. Inter-meshing spur gears 54, 55 synchronize the rotation in opposite directions of the shafts 50, 51.

Referring to FIG. 3, downwardly extending stops 79, 80 are positioned above the termination of channels 17, 18 adjacent walls 31, 32, respectively and are connected to limit switches 81, 82, respectively, positioned on the cover 21.

It can be seen in FIG. 7 that the channels 17, 18 terminate in inwardly directed, transversely extending channels 83, 84, which terminate adjacent side walls 20. As seen in FIG. 4, the channels 83, 84 are disposed beneath the forward faces of gears 39, 40, respectively.

In the operation of the device 10, the wire 14 is fed beneath bale 12 and along its two opposite side surfaces in the same vertical plane and thence along the top of the bale 12. Wire distal portion 15*a* enters device 10 through channel 17 and wire distal portion 15*b* enters device 10 through channel 18. The wire portions 15*a*, 15*b* are aligned along channels 17, 18 by being tensioned between walls 23, 24 and the upper periphery of rollers 25, 26 as shown in FIG. 5. As the wire portions 15*a*, 15*b* advance through their respective channels, they pass through the slots 33, 34 of rotatable elements 35, 36. The axes of rotation of rotatable elements 35, 36 are coincident with the longitudinal axes of the wire portions 15*a*, 15*b*. The wire portions 15*a*, 15*b* continue to advance through their respective channels until distal end 16*a* contacts protrusion 80 of limit switch 82 and distal end 16*b* engages protrusion 79 of limit switch 81.

At that time, the forward advance of portions 15*a*, 15*b* is stopped. The switches 81, 82 are connected to conventional mechanisms within device 10 which actuate hydraulic cylinders 61, 62 to begin to retract their respective pistons 63, 64. The retraction of pistons 63, 64 causes the pinion gears 71, 72 to begin to pivot in a horizontal plane about their respective shafts 73, 74 due to the inter-meshing of rack teeth 67, 68 with pinion gear teeth 69, 70. As the gears 71, 72 begin to pivot, pinion gear surfaces 77, 78 contact a section of the wires 15*b*, 15*a* adjacent the distal ends 16*b*, 16*a*, respectively, and cause those sections of wires 15*b*, 15*a* to begin to bend in a substantially horizontal plane. As the distal portions of the wires 15*a*, 15*b* are moved along their horizontal path of travel, they pass beneath the unbent portions of wires 15*b*, 15*a* and through the respective vertical planes of the unbent wire portions 15*b*, 15*a*. The length of surfaces 77, 78 is equal to the distance between the two wire portions 15*a*, 15*b* so that tongues 75, 76 are unencumbered as they move along their respective paths of travel.

When the bent wire sections assume their respective positions as shown in FIG. 8, they are abutting the forward faces of gear 39, 40 and are slightly above the top surfaces 43*a*, 44*a*, of projections 43, 44 with the sections of the bent portions immediately adjacent distal ends 16*b*, 16*a* extending beyond the projections 43, 44. The angles $\alpha$ formed by the bent sections with the respective unbent portions of wires 15*a*, 15*b* should be slightly more than or slightly less than 90°.

Conventional mechanism is disposed within device 10 to signal the end of the retractions of pistons 63, 64, and thus the bending stage of the knot forming process; the hydraulic cylinders 61, 62 are actuated to extend pistons 63, 64 to their rest positions, thereby returning tongues 75, 76 to their respective rest positions as shown in solid lines in FIG. 4.

When the bending means has completed its cycle, the folding operation is begun by conventional mechanism within device 10 actuating the hydraulic cylinder (not shown) within housing 58 to drive piston 57 downwardly, thereby causing rack 56 to turn gear 54 which causes shaft 50 to rotate and teeth 52 on gear 48 to engage teeth 41 on gear 39. Simultaneously, the gear 54 causes gear 55 to rotate, turning shaft 51 and gear 49. Teeth 53 on gear 49 meshingly engage teeth 42 on gear 40 which effects rotation of gear 40. The path of travel of the gears 48, 39, 49, 40 is shown by arrows E, F, G and H, respectively, in FIGS. 6 and 8. If it is desired to form a knot wrapped oppositely, the rotation of the gears can be easily reversed.

Rotation of gears 39, 40 causes the rotation of the rotatable elements 35, 36 in a counter-clockwise direction. As the rotatable elements 35, 36 begin their respective rotations, the top surfaces 43*a*, 44*a* of projections 43, 44 contact the bent sections of wires 15*b*, 15*a*, respectively, and begin to fold or curve those portions upwardly about the unbent portions 15*a*, 15*b*. The rotatable elements 35, 36 rotate about the longitudinal axis of wire portions 15*a*, 15*b* with those unbent wire portions remaining stationary. Continued downward movement of rack 56 results in the continued curving of the bent wire portions inwardly of themselves because of the angles being less than 90°. The rotatable elements 35, 36 are rotated less than 360°, preferably through about 275°. When the piston 57 is fully extended to its operational position, it results in the bent wire sections being folded to diagonally opposed loops, 15*c* and 15*d* in the flat open rectangular knot 11.

It is readily understood that, if desired, the loop 15*c*, 15*d* may be formed by bending and rotating the end portions 15*a*, 15*b* so that the loops 15*c*, 15*d* spiral outwardly, rather than inwardly. Also, the end portions 15*a*, 15*b* may be rotated in opposite directions, from those shown, to form the loops 15*c*, 15*d*. Any reasonable number of revolutions may be employed for loops 15*c*, 15*d* and the degree of rotation in forming loops 15*c* or 15*d* may be as little as 90° to provide some traction, though such a loop or bight may not be too useful for most applications. The ends 16*a*, 16*b* may terminate, projecting generally in any radial direction, for example either angling up or down.

As seen in FIG. 7, the channels 17, 18 extend through the bottom 22 of the base 21 in a longitudinal direction for a distance equal to the unbent wire portions 15*a*, 15*b*. The channels 17, 18, 83, 84 are interconnected and are in the shape of the complete knot 11 to provide a means of allowing the knot 11 to be stripped downwardly and hence released from the device 10 onto the top of the burlap covering 13 of bale 12 when the bale 12 is lowered by conventional means from bottom 22. The lowering of the bale 12 strips the unbent wire portions 15*a*, 15*b* from between rollers 25, 26 and walls 23, 24, respectively. The completed knot 11 has the distal ends 16*a*, 16*b* projecting downwardly after the wire and knot 11 is stripped downwardly out of the housing 10, the double acting cylinder 58 is actuated to retract its piston 57 and cause the rotatable elements 35, 36 to be rotated back to their rest positions, as shown in FIG. 8.

The knot 11 illustrated in the drawing is quite strong in that the ends 16*a*, 16*b* project into the covering 13 and in that a portion of the bale 12 protrudes upwardly through the open space formed by the joined ends of wire 14. Each knot 11 formed by device 10 is separate and does not require any cutting means to sever the knot from additional wire, in the event that a prescribed length of wire is used.

It is now seen that the knot 11, thus formed, includes, as shown in FIG. 2, a pair of spaced offset parallel longitudinally extending increments 16*c*, 16*d* respectively integrally connected to transversely extending increments 16*e*, 16*f*, the angles being subtended, at their junction. The loops 15*c*, 15*d* join the end portions of increments 16*e* and 16*f* to increments 16*c*, 16*d*. Hence, the increments 16*c*, 16*d*, 16*e*, 16*f* form a continuous parallelogram i.e., rectangle forming a perimeter about an open interior, denoted by numeral 16*g*.

It is obvious to those skilled in the art that many variations may be made in the embodiment here chosen for purpose of illustrating the invention and full resort may be had to the doctrine of equivalents without departing from the scope of the invention as defined by the appended claims.

What I claim is:

1. A bale tying device for shaping the distal portions of a wire into a knot after the wire has passed about the outer perimeter of the bale, comprising:
   (a) means for aligning said distal portions in spaced parallel relationship so that one of said distal portions extends past said other distal portion in the opposite direction in overlapping relationship;
   (b) means for bending a section of each of said distal portions about a point adjacent the distal end of each of said portions towards the unbent distal portions with said distal ends extending through the vertical planes of said unbent distal portions; and
   (c) means for folding each of said distal ends about each unbent distal portion, the vertical plane of which is passed by said distal end, less than 360° to form a knot having said distal ends angled downwardly.

2. A bale tying device as claimed in claim 1 wherein said bending means includes a pivotally mounted wire engaging surface outboard of each of said distal portions and means for selectively pivoting each of said surfaces between an operative position in engagement with said distal portions and inoperative positions out of engagement with said distal portions.

3. A bale tying device as claimed in claim 2 wherein each of said wire engaging surfaces is pivoted through an arc greater than 90°.

4. A bale tying device as claimed in claim 3 wherein each of said bending means includes a gear pivotally mounted about a vertical axis and wherein each of said engaging surfaces comprises a tongue axially extending from said gear.

5. A bale tying device as claimed in claim 4 wherein each of said bent portions passes beneath each of said unbent distal portions.

6. A bale tying device as claimed in claim 5 wherein each of said folding means includes a rotatably mounted element, each of said elements having a radial slot longitudinally extending therethrough, each of said slots being dimensioned to receive said unbent wire portions, when the rotatable elements are in their rest positions, the axis of rotation of each of said elements being coincident with the longitudinal axis of said unbent wire portions within said slots, each of said elements having means thereon for contacting each section of said bent wire portions which passes through each of said vertical planes and means operatively connected to said element to rotate said elements through a path of travel greater than 180° and less than 360°.

7. A bale tying device as claimed in claim 6 including a housing for said bending and folding means, said housing having a bottom surface, and said aligning means comprising downwardly opening channels longitudinally extending through said bottom surface in spaced, parallel relationship, a portion of each of said channels being in registry with one of said slots in said rotatable elements when said elements are in their rest positions.

8. A bale tying device as claimed in claim 7 wherein each of said channels is provided with transversely yieldable wire engaging means so as to maintain said unbent wire portions within said channels.

9. A bale tying device as claimed in claim 8 wherein each of said channels terminate in a downwardly opening channel which transversely extends through said bottom surface, said transversely extending channels being in communication with their respective longitudinally extending channels so as to form the shape of said knot to allow said knot to be released from said device upon the formation of said knot.

10. A method of forming a wire knot about a bale of material, comprising the steps of:

(a) passing wire about the exterior surface of said bale;

(b) aligning the distal portions of said wire in spaced, parallel relationship so that one of said distal portions extends past said other distal portion in the opposite direction;

(c) bending a section of each of said distal portions inwardly about a point adjacent the distal end of each of said portions towards the unbent distal portions, said distal ends passing beneath and through the vertical plane of said unbent wire portions, with the angle formed by each of the bent distal sections and its unbent distal portion being less than 90°; and (d) folding inwardly of itself each of said distal sections which extends through each of said vertical planes about each unbent distal portion less than 360° but greater than 180° to form a knot having each of said distal ends angled downwardly and in engagement with said bale.

11. A knot formed by the method of claim 10.

12. A knot formed by the junction of two end portions of wire comprising:

(a) a pair of offset generally parallel, longitudinally extending increments of said wire;

(b) a pair of off generally parallel, transversely extending increments being respectively integrally joined to the end of said longitudinally extending increments; and (c) loops on the other end portions of said transversely extending increments, whereby said longitudinally extending increments and said transversely extending increments and said transversely extending increments form a parallelogram perimeter around an open interior.

13. The knot defined in claim 12 wherein said loops are sufficiently tight that they are self-locking on said longitudinally extending increments when pull is exerted on said transverse increments.

* * * * *